US007346948B1

(12) United States Patent
Swezey et al.

(10) Patent No.: US 7,346,948 B1
(45) Date of Patent: Mar. 25, 2008

(54) BASIC BED LOUNGE

(76) Inventors: Robert L. Swezey, 10532 Garwood Pl., Los Angeles, CA (US) 90024; Richard Swezey, 1326 16th St., Santa Monica, CA (US) 90404

( * ) Notice: Subject to any disclaimer, the term of this patent is extended or adjusted under 35 U.S.C. 154(b) by 0 days.

(21) Appl. No.: 11/473,785

(22) Filed: Jun. 23, 2006

(51) Int. Cl.
*A47C 20/00* (2006.01)

(52) U.S. Cl. ..... 5/653; 5/924; 5/657; 297/440.12

(58) Field of Classification Search ..... 5/633, 5/653, 657, 924; 297/440.12, 352, 230.1, 297/230.12
See application file for complete search history.

(56) References Cited

U.S. PATENT DOCUMENTS 2,940,511 A * 6/1960 Gomes ..... 297/440.12
3,359,036 A * 12/1967 Druth et al. ..... 297/352
4,015,298 A 4/1977 Scott
4,258,706 A 3/1981 Shank
4,385,782 A * 5/1983 Clark, Jr. ..... 297/440.12
4,535,492 A 8/1985 Sebest
5,423,098 A 6/1995 Swezey et al.
5,829,830 A 11/1998 Maloney
D427,833 S 7/2000 Robinson
6,155,647 A * 12/2000 Albecker, III ..... 297/452.16
6,814,709 B2 * 11/2004 Schwartz et al. ..... 601/57

* cited by examiner

*Primary Examiner*—Michael Trettel
(74) *Attorney, Agent, or Firm*—J. E. McTaggart

(57) ABSTRACT

A basic version of the Bed Lounge™ includes a removable, inter-changeable, and washable fabric slip cover enclosing a foam, fiber, filled-pillow, layered padding over a flat light-weight inner body/frame structure, forming a layered composite that is exceptionally lightweight (2-3 lbs.), extremely durable and yet highly comfortable and supportive to the upper body of the user. Due its compact size, the basic bed lounge can be used on existing seating and furniture to augment support and comfort. It has the ability to be flattened to a very low profile so it can be easily carried in one hand, slung over the shoulder, hung like a suite bag on a hanger in the closet and stored under furniture, under a bed or in an automobile trunk for use when traveling.

11 Claims, 2 Drawing Sheets

BASIC BED LOUNGE

FIELD OF THE INVENTION

The present invention relates to household bedding accessory furniture and more particularly it relates to an ergonomic compact basic Bed Lounge™ that can be readily folded out into flat form for convenience in transporting and storing.

BACKGROUND OF THE INVENTION

For those who spend periods of time sitting in a bed, seating, furniture, sofa or even on a floor and/or against a wall, it is important to provide proper support to particular regions of the body to avoid discomfort, fatigue and/or body deformation and musculo-skeleton strains. Ordinary cushions and pillows fail to provide necessary support and structural integrity, which requires a chair-like bed lounge typically with at least a back portion with two attached arm-rests, one at each side, and preferably a neck support/head-rest. To accommodate the needs of different individuals with regard to size, weight, age, activity, etc., the Bed Lounge is preferably provided with several user adjustment capabilities, e.g. relating to tilt-back, arm-rest and seat-back spacing, lower back support, neck-rest height and inclination.

KNOWN ART

Bedding furniture in the field of this invention has been known under such names as "bed bolster", "husband" and "study rest". Typically such items have been made entirely from foam material so that characteristically they lack support and structural consistency, being overly soft and flexible, and/or they are inconveniently heavy, bulky and costly to ship to stores, to warehouse and to display in stores and inconvenient to store in the home and to transport in an automobile and while traveling.

U.S. Pat. No. 5,423,098 to the present inventors disclosed an ergonomic BED LOUNGE made with a fabric cover enclosing foam padding and fiber composited over a main structure formed from plastic sheet material to provide the required strength and stability in an assembly that is lighter in weight and more individually adjustable than all-foam construction. The Bed Lounge™ featured back inclination adjustment, a built-in adjustable lower back pillow, a doubly adjustable neck pillow and side arm-rests whose forward portions can be adjusted for end separation and for angle of recline.

Pending U.S. patent application Ser. No. 11/240,538 was filed Sep. 30, 2005 by the present inventors for a full-featured DUAL-MODAL-SHAPE BED LOUNGE that can be folded to a compact size and shape for storage purposes.

U.S. design Pat. 427,823 to Robinson shows a BED PILLOW WITH ARM RESTS AND COVER.

U.S. Pat. No. 5,829,830 to Maloney discloses a removable SUPPORT INSERT FOR A HIGH CHAIR directed to positioning and supporting the upper torso of an infant seated in the high chair.

U.S. Pat. No. 4,015,298 to Scott discloses a TILTABLE HEADBOARD for supporting the head and upper body portion of a person who is in a reclining-seated position on the bed.

U.S. Pat. No. 4,535,492 to Sebest discloses a motorized PILLOW BED MECHANISM that provides varying degrees of elevation to separately movable head-rest and back-support sections.

OBJECTS OF THE INVENTION

It is a primary object of the present invention to provide a relatively small, lightweight basic version of the Bed Lounge that has the ability to be made flat so that it can be easily carried in one hand, slung over the shoulder for transporting to the beach or events, or hung like a suit bag on a hanger in a closet or on a hook on the back of a door.

It is a further object that the Bed Lounge be based on a flat body/frame that is economical to manufacture, ship and warehouse.

SUMMARY OF THE INVENTION

The above and further objects and advantages have been realized in the present invention of a basic version of the trademarked Bed Lounge that includes a fabric slip cover that is removable, inter-changeable, and washable. The slip cover encloses a foam, fiber, filled-pillow, layered padding over an inner body/frame structure cut from a flat panel of plastic molded with an air core for light weight. The combination of foam, fiber, filled-pillow inserts and structural flat body/frame creates a layered composition or laminate that is extremely durable and yet highly comfortable and supportive to the upper body of the user. This version of the Bed Lounge™ is smaller, exceptionally lightweight (2-3 lbs.), and has the ability to flatten so it can be easily carried in one hand, slung over the shoulder, hung like a suite bag on a hanger in the closet and stored under furniture or bed owing to its very low profile, and further compressibility given its construction elements, when in flattened mode

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
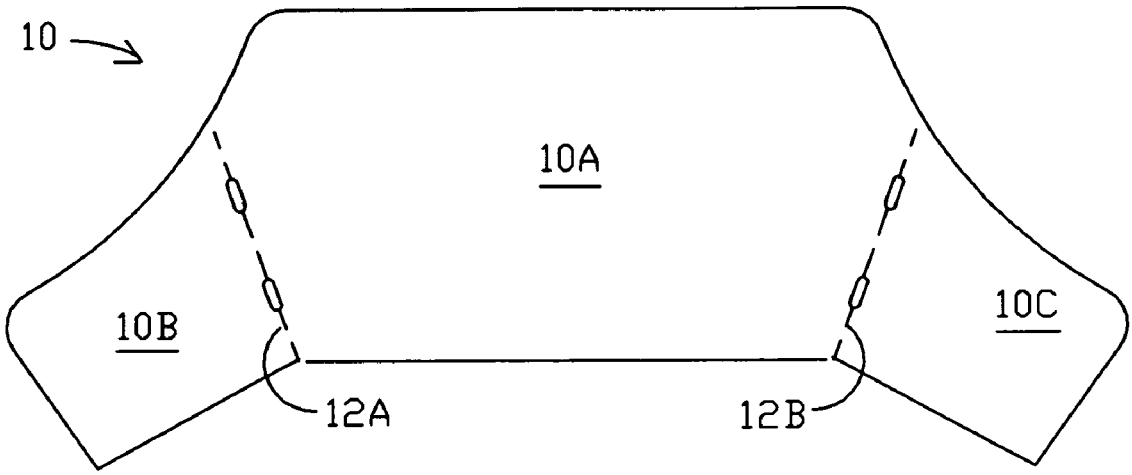
FIG. 1 is a plan view of the main body/frame flat structure of a basic bed lounge of the present invention.

FIG. 1 is a plan view of the main body 10 forming the body/frame structure of a basic bed lounge of the present invention. Body 10 is cut as a single piece from a flat plastic panel that is formed to have smooth firm surfaces on both sides spaced to a uniform thickness of about ¼ inch by internal spacer walls between hollow air chambers. Typically the plastic panel is formed by extrusion to provide uniform hollow elongated parallel chambers that are approximately square in cross-section, and body 10 is cut to orient the chambers horizontally. Two fold lines 12A and 12B, are embossed and slotted as shown to form "living hinges" that divide the body 10 into three hinge-attached portions: back portion 10A and the two flanking arm rest portions 10B and 10C.

Figure 2:
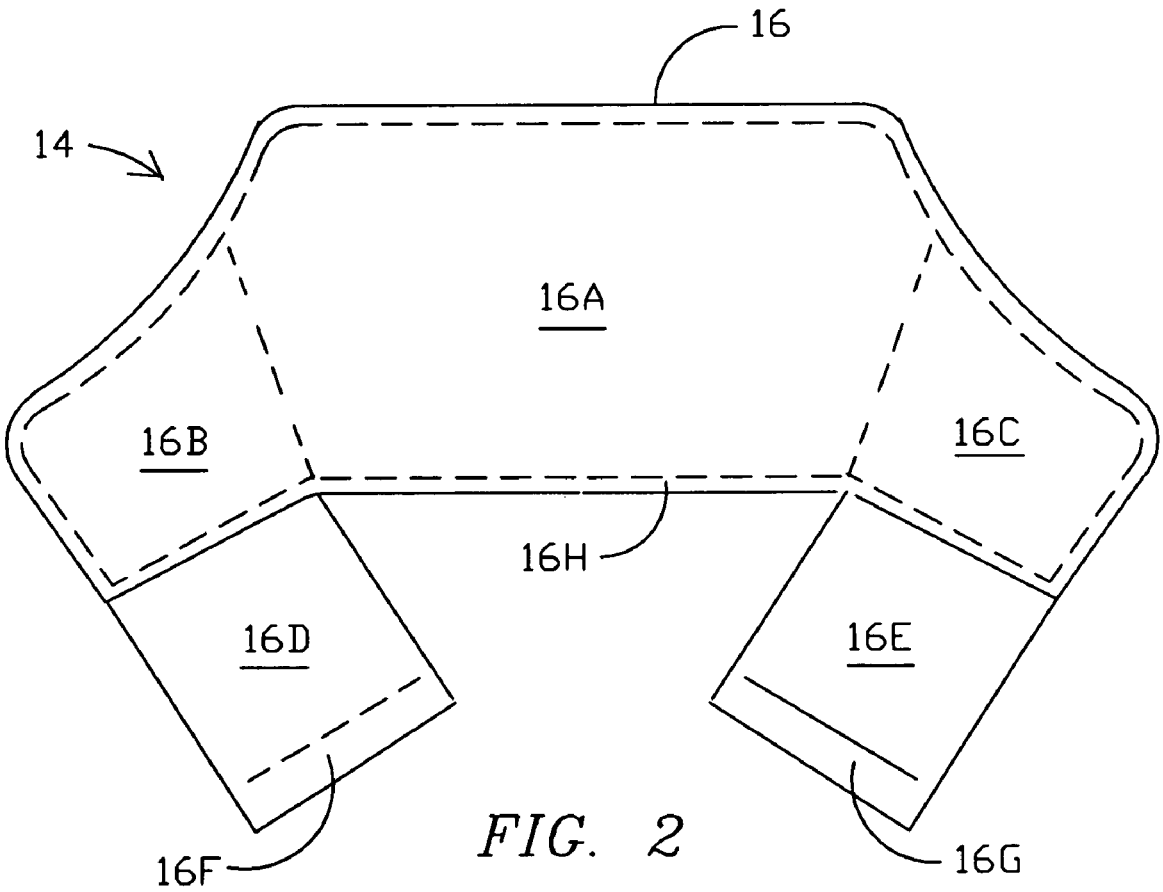
FIG. 2 is a plan view of the basic bed lounge of the present invention formed by the main body/frame of FIG. 1 enclosed in a slip cover and padding system and shown extended into the flat storage mode.

FIG. 2 is a plan view of the basic bed lounge 14 of the present invention formed by the body 10 of FIG. 1 enclosed in a fabric slip cover 16. Bed lounge 14 is shown extended in the flat storage mode. The region containing main body 10, shown in broken lines including back portion 16A and arm rest portions 16B and 16C, is padded with internal foam and fiber enclosed by the slip cover 16, to form a thickness of typically 3 to 4 inches but made thicker in the lower back region. Fabric flaps 16D and 16E, extending from the rear side of the lower edge of arm rest portions 16B and 16C, are fitted in marginal regions 16F and 16G (indicated by dashed lines) with mating fastening materials such as Velcro hook-and-loop that provide adjustable attachment.

The thin, flat form allows the basic bed lounge 14 to be placed against the bed's headboard and hidden with conventional decorative pillows, or stored tucked behind the headboard. Again, owing to its thin and compressible profile, it can be economically shipped to stores and warehoused, as the flat shape enables stacking and pallet handling in much greater quantities.

Figure 3:
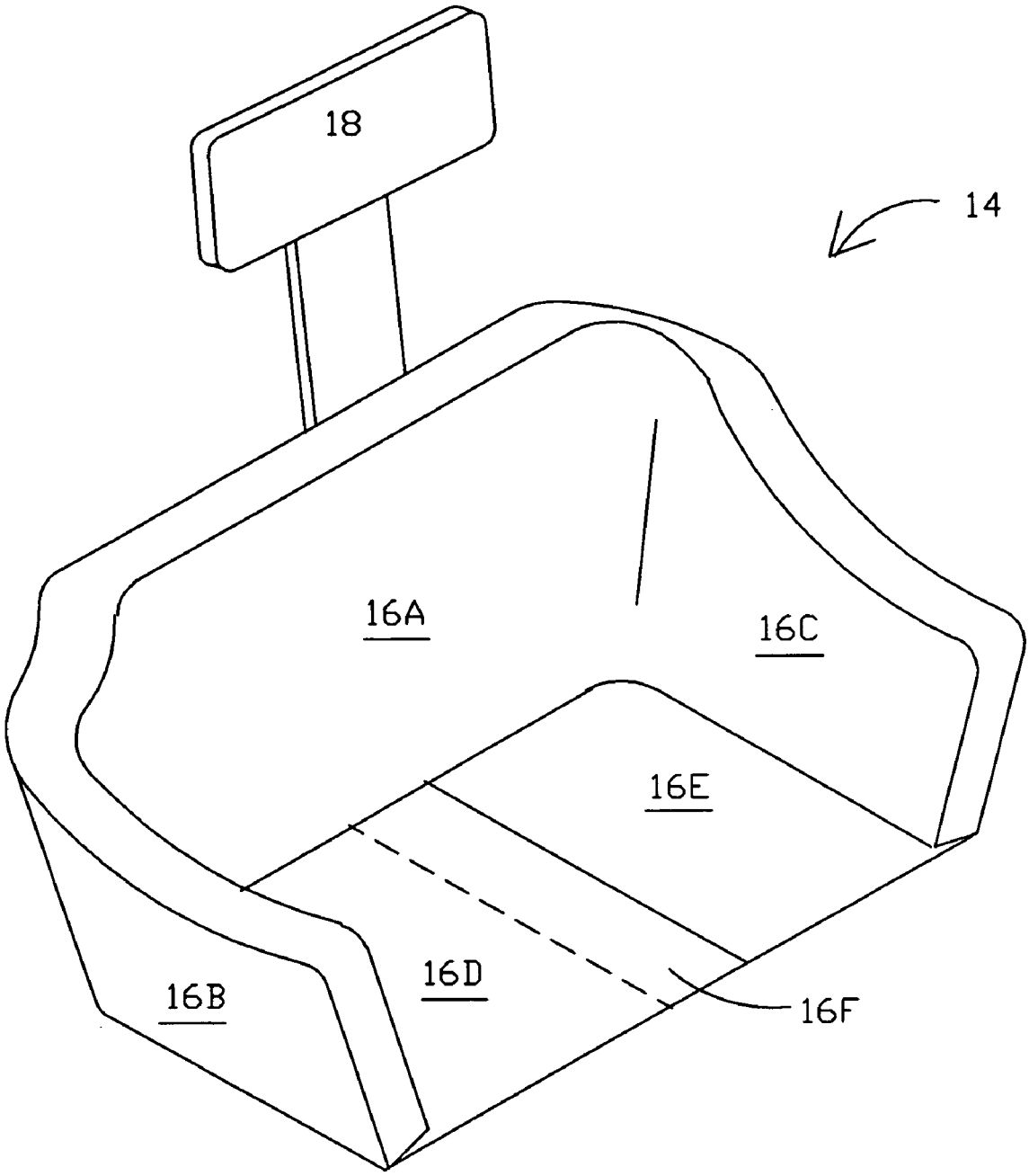
FIG. 3 is a frontal perspective view of the basic bed lounge of FIG. 2, formed into the deployment mode as a seat including a headrest.

FIG. 3 is a frontal perspective view of the bed lounge 14 of FIG. 2, formed into the deployment mode, and fitted with a headrest 18. Armrests 16B and 16C are folded forward and the two panels are fastened together in the overlapping region 16F. The amount of overlap can be adjusted to provide any desired spacing between the armrests 16B and 16C.

Headrest 18 is constructed from a T-shaped piece of plastic with a long stem that slips into a opening or sewn long "pocket" in slip cover 16. This allows the stem to maintain a frictional tension and keep headrest 18 in place after the user shifts it up and down as desired for head, neck, and shoulder support. Headrest 18 is also adjustable with regard to the angle or tilt attitude. At the cross point of the T-shape where the stem perpendicularly meets the cross member, an embossed line or score has been made into the plastic: this line creates a hinge point, or "living hinge" that is laminated with the composite of foam, fiber, (and optionally the filled pillow) to create a spring-like tension at the cross point. As the user tilts or rotates the headrest 18 to a suitable position of support for the head, neck, and/or shoulders, the combination of composites and the hinge exert a gentle upward force. This gentle force lets the headrest 18 comfortably nestle the user's head and neck. Importantly, it tracks or follows the user's head as the user looks up or down. Hence, the headrest 18 is able to track with the user's head through an arc of different positions without the user needing to re-adjust the headrest 18. The user can go from looking down reading a book or working on a laptop computer to looking straight ahead to looking upward to watch television. Other loungers and bed rests have armrests that attach to the back in an abrupt transition, step-like, from the armrests to the body or seat back of the lounger.

The headrest pocket can be made with an additional opening at the bottom so that the headrest can be inserted and not protrude at the top; this makes it more compact and easy to carry and/or store.

The armrests 16B and 16C are shaped as a scoop that continuously slopes from the shoulders into the arms. The gentle arc is designed so that it provides continuous, consistent support to the user's upper body as they rock back, incline, or position the lounger in a reclining elevation that suits them for the desired task (i.e. reading, nursing baby, gaming, watching TV, etc.). The arc of the armrests 16B and 16C also allow the user a continuous point of support, again equalizing and distributing weight, being a perch for the arms and elbows when holding a book, magazine, craftwork, baby, and the like.

The internal body 10 (FIG. 1) and composite elements work together and play a key role in the lounger's ability to support the user's full weight at these inclined angles. The lounger 14 provides optimal utility in inclined elevations when used against a solid surface such as a wall or headboard. The framework composite and the arc of the armrests 16B and 16C not only support the user but equalize the user's upper body weight and distribute for a pleasing lounging experience without noticeable pressure points to distract from the relaxing, near-floating sensation.

As an alternative to forming the body 10 from a single sheet of plastic by employing "living hinges" between the three portions as described above, actual hinges could be utilized in conjunction with three separate body portions, but this would impose increased labor and cost.

The slip cover 16 functions as an integral part of the lounger's structure. As an alternative to the Velcro-type hook-and-loop closure material, the panel fastenings 16F and 16G could be implemented in other ways, e.g. zippered, domed or buttoned. The interconnection of the panels 16D and 16E hold the lounger in the its seating mode and create a seat bottom that the user sits upon. Making the fastening adjustable allows the width of the armrests to be widened or narrowed to accommodate the user's body shape or the activity the user is doing.

The flaps 16D and 16E extend from the rear region of base of the armrests. This is necessary so that they wrap beneath the broad or "resting" portion of the armrests and hold the unit together when each flap is connected to one another. The flaps can be cushioned for enhance comfort and/or they can be configured to accept other seat cushions.

Side pockets can be added to the slip cover 16 to allow the user to store items such as books, I-pod, baby bottles, eyeglasses, etc.

The slip covers are envisioned as being made in a variety of colors and fabrics for users to choose from.

To support the low back, a filled (either feather, down, or synthetic fill) lumbar pillow is incorporated into the design. It has been found that a crescent-shaped filled pillow is most pleasing to users in comfort and support. To this can be added memory foam for a still greater degree of comfort.

Other possible variations include heat, massage, a reading lamp, and a special armrest configuration specifically designed for nursing mothers.

As an alternative to extruding, the plastic panel for the body could be injection-molded, which would allow/require the internal air-chamber regions to be non-uniform in width.

As an alternative to cutting the body from a panel in the required outline shape, the body shape could be formed originally in a molding process.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A basic bed lounge, that can be easily user-converted back and forth between a chair-like normal shape as a seat for supporting a user in a sitting position and a generally flattened shape for convenient transportation and storage, comprising:

a main body, originally fabricated in flat form, having a back support region flanked by two armrest regions:

hinge means providing foldable attachment between the back support region and each of the two armrest regions, enabling said bed lounge to be formed into a seat shape;

a fabric slip cover fully enclosing said main body and configured with two attached fabric flaps each extending from a rear bottom edge of a corresponding one of the armrest regions; and fastening means, disposed along an outer margin of each of the flat flaps, made, arranged and located to mutually engage and fasten the two fabric flaps together in an overlapping interfacing region thereof that forms a user seat region when said bed lounge is formed into a seat shape and provides structural integrity that becomes reinforced by weight of a seated user on the overlapping fabric flaps.

2. The basic bed lounge as defined in claim 1 wherein said hinge means comprises a pair of "living" hinges in said main body, formed by embossed lines and slots that facilitate folding.

3. The basic bed lounge as defined in claim 1 further comprising, in said fabric slip cover, user-releasable closure means made and arranged to provide user access to internal items and for cleaning purposes.

4. The basic bed lounge as defined in claim 1 wherein said fastening means comprises a mating hook and loop type fastening system, with hook fasteners affixed to one of the fabric flaps and mating loop type fasteners affixed to the other fabric panel in the overlapping interfacing region thereof.

5. The basic bed lounge as defined in claim 1 further comprising:

a neck rest, for resiliently supporting a neck region of the user's body, including adjustable neck rest support means for positioning and retaining said neck rest located centrally above the rear portion of said bed lounge.

6. The basic bed lounge as defined in claim 5 wherein said neck rest support means comprises a T-shaped spine having an upper transverse portion and a downwardly-extending vertically-elongated leg portion enclosed and frictionally retained, in a passageway provided in said slip cover at a back region of said bed lounge, in a manner to allow the user to adjust said neck rest with regard to height.

7. The basic bed lounge as defined in claim 6 further comprising an opening configured at a lower end of the passageway formed in said slip cover, made and arranged to enable the leg portion of said spine to be inserted in an inverted orientation so as to retain said neck rest in a non-extending disposition for compact storage and handling.

8. The basic bed lounge as defined in claim 6 wherein the upper transverse portion of said spine is attached to the leg portion thereof by a "living" hinge, formed integrally in said spine, that allows the user to rotationally adjust said neck rest with regard to attitude.

9. The basic bed lounge as defined in claim 6 further comprising a neck pillow associated with the upper transverse portion of said head rest, thus made adjustable for user comfort.

10. The basic bed lounge as defined in claim 6 further comprising a lower back pillow, incorporated in the back region of said bed lounge, made, arranged and located to provide special support to a lower back region of the user's body, said lower back pillow being captivated in a floating manner within said slip cover so as to enable the user to adjustably locate and orient said lower back pillow for user comfort.

11. A method of transforming a flattened storage/transportation form of a bed lounge having a body/frame covered with padding and a fabric slip-cover into a three-dimensional form for deployment as a seat-like bed lounge, comprising the steps of:

originally fabricating the body/frame with two hinge lines dividing a back region thereof from two opposite armrest regions thereof;

originally providing the fabric slip-cover with a pair of fabric flaps each extending from a corresponding bottom edge of the two armrest regions of the slip-cover, the fabric flaps being each provided with mating detachable attachment means along an outwardly-extending margin thereof;

folding the armrest regions relative to the back region of the body/frame to a desired spacing between the armrest regions so as to form the seat-like bed-lounge; and attaching the two fabric flaps in an overlapping relationship via the attachment means so to retain the desired spacing between the armrest regions and to provide a seat region for a user.

* * * * *